US007030849B2

(12) United States Patent
Au et al.

(10) Patent No.: US 7,030,849 B2
(45) Date of Patent: Apr. 18, 2006

(54) ROBUST LCD CONTROLLER

(75) Inventors: Ho Sang Au, Hong Kong (HK); Kam Tim Cheung, Hong Kong (HK)

(73) Assignee: Freescale Semiconductor, Inc., Austin, TX (US)

( * ) Notice: Subject to any disclaimer, the term of this patent is extended or adjusted under 35 U.S.C. 154(b) by 487 days.

(21) Appl. No.: 10/613,898

(22) Filed: Jul. 3, 2003

(65) Prior Publication Data

US 2005/0001809 A1 Jan. 6, 2005

(51) Int. Cl.
*G09G 3/36* (2006.01)

(52) U.S. Cl. ..... 345/98; 345/537; 345/538; 710/53; 710/54; 710/57

(58) Field of Classification Search ..... 345/87, 345/98–100, 537, 538; 710/53–57
See application file for complete search history.

(56) References Cited

U.S. PATENT DOCUMENTS 4,796,203 A 1/1989 Roberts
5,850,572 A * 12/1998 Dierke ..... 710/53
5,963,192 A 10/1999 Wong et al.
6,014,120 A 1/2000 Chiu et al.
6,075,831 A * 6/2000 Schnizlein et al. ..... 375/359
6,078,316 A 6/2000 Page et al.
6,204,864 B1 3/2001 Chee
6,215,465 B1 4/2001 Asakura et al.
6,229,859 B1 * 5/2001 Jeong et al. ..... 375/354
6,304,297 B1 * 10/2001 Swan ..... 348/556
6,362,834 B1 3/2002 Ishii
2001/0024181 A1 9/2001 Kubota et al.

OTHER PUBLICATIONS

Intel®, "Bandwidth Calculations for SA-1110 Processor LCD Displays Application Note," Jun. 1999, Order No. 278287-001.

* cited by examiner

*Primary Examiner*—Vijay Shankar
*Assistant Examiner*—Steven Holton
(74) *Attorney, Agent, or Firm*—Charles Bergere

(57) ABSTRACT

An LCD controller (10) has a DMA unit (18) and a FIFO memory (20) for storing display data. The LCD controller also has a display data generator (26) that generates display information using a line of the display data stored in the FIFO memory in accordance with a predefined algorithm. A holding register (28) is connected to the display data generator and stores the generated display information. A multiplexer (34) selects for display either the data stored in the FIFO memory or the generated display information. The generated display information is selected when there is a bus overload indicating that the data stored in the FIFO may be erroneous.

16 Claims, 1 Drawing Sheet

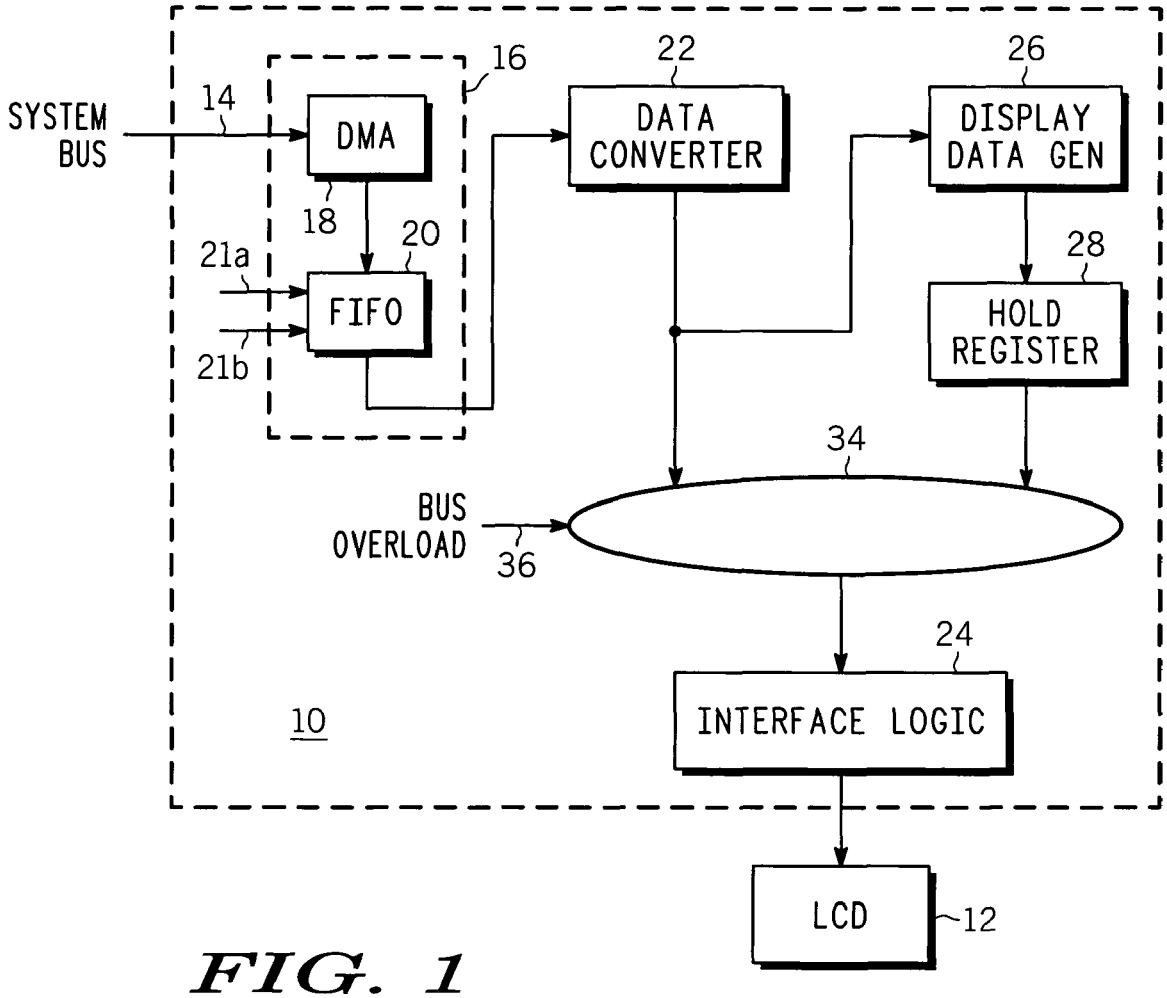
FIG. 1
FIG. 2
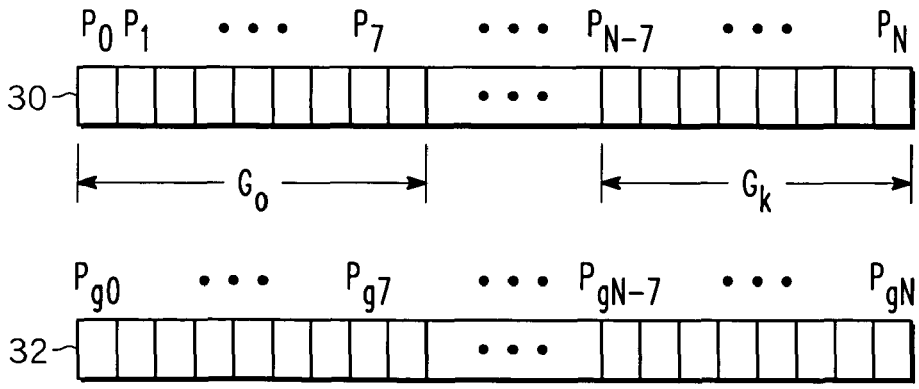

ROBUST LCD CONTROLLER

BACKGROUND OF THE INVENTION

The invention generally relates to a display controller and, and more particularly, to a controller for a liquid crystal display.

LCD monitors receive image data from an external memory and display an image represented by the data on the monitor. The image data typically is supplied from one of an internal graphics memory, a shared main memory, or an external memory. An LCD controller that does not have its own memory must arbitrate the system bus to get the display data from the shared main memory or the external memory. In this scenario, the LCD controller fetches data from memory and outputs the data to the display at a fixed rate.

Image flickering has long been a problem for display makers. Flickering may occur because the image data is not updated or refreshed fast enough. One reason image data is not updated fast enough is due to a system bus overload or collisions between graphics memory updating and display monitor refreshing. During system bus overload, the actual latency of fetched data is longer than an allowable value, such that the LCD controller does not receive the requested data, which causes erroneous data to be displayed. This display of erroneous data is recognized as image flicker.

The most typical practical solutions to the bus overload problem is to reduce the probability of bus overload by having a large FIFO inside the LCD controller or by reducing the loading of the bus by using a faster system clock or a cache controller. However, it may not be practical or cost effective to include the additional hardware required to support a large FIFO. An alternative to the hardware FIFO is to use software double buffering. In software double buffering, data is written to system memory buffers and then copied to a fixed graphics display memory. However, a problem with software double buffering is that there is an impact on performance due to the need to copy an entire extra screen's worth of data per display frame, and thus the software double buffering technique may not avoid the bus overload problem.

Thus, a need exists for a managing display data during intermittent bus overflow conditions in order to achieve a flicker free display.

BRIEF DESCRIPTION OF THE DRAWINGS

The following detailed description of preferred embodiments of the invention will be better understood when read in conjunction with the appended drawings. For the purpose of illustrating the invention, there is shown in the drawings embodiments that are presently preferred. It should be understood, however, that the invention is not limited to the precise arrangement and instrumentalities shown. In the drawings:

FIG. 1 is a schematic block diagram of an LCD controller circuit in accordance with an embodiment of the invention; and FIG. 2 is a schematic diagram for showing how display data is generated and stored in a holding register in accordance with one embodiment of the invention.

DETAILED DESCRIPTION OF PREFERRED EMBODIMENTS

The detailed description set forth below in connection with the appended drawings is intended as a description of the presently preferred embodiments of the invention, and is not intended to represent the only forms in which the present invention may be practiced. It is to be understood that the same or equivalent functions may be accomplished by different embodiments that are intended to be encompassed within the spirit and scope of the invention. In the drawings, like numerals are used to indicate like elements throughout.

The present invention provides an LCD controller that generates display data using a predefined algorithm and stores the generated data in a holding register. The holding register data is output to the display during a system bus overload.

More particularly, an aspect of the invention provides a video display controller including a memory unit that receives display data from an external bus and temporarily stores the display data. A data converter is connected to the memory unit for receiving the display data therefrom and converting the display data to a converted data having a predetermined format. A display data generator is connected to the data converter for receiving the converted data and generating temporary display data therefrom using a predefined algorithm. A holding register is connected to the display data generator for storing the generated temporary display data. A multiplexer connected to the data converter and the holding register receives the converted data and the generated temporary display data, and selects and outputs one of the converted data and the generated temporary display data in accordance with a bus overload signal. The bus overload signal indicates a predetermined condition of the external bus.

Yet another embodiment of the invention provides a method of processing display data received from a bus and provided to a LCD. The method includes the steps of:

receiving display data from an external bus and storing the received display data in a memory unit;

reading the display data stored in the memory unit;

converting the read display data to a predetermined format;

providing the formatted display data to a first input of a multiplexer and to a display data generator;

the display data generator generating temporary display data using the formatted display data in accordance with a predefined algorithm;

storing the generated temporary display data in a holding register;

providing the temporary display data from the holding register to a second input of the multiplexer;

selecting by the multiplexer one of the formatted display data and the generated temporary display data in accordance with a bus overload signal; and outputting the selected data to a display device.

Referring now to FIG. 1, a schematic block diagram of a video display controller 10 that outputs display data to a video terminal or display unit in accordance with an embodiment of the invention is shown. The video display controller 10 is particularly suited for driving data to an LCD 12. However, those of skill in the art will appreciate that the inventive concepts disclosed herein are applicable to other display devices. The LCD 12 is an LCD type of monitor suitable for displaying color graphic images. The LCD 12 may have a resolution of 320 by 240 pixels, although this is exemplary and the LCD 12 is not limited to any particular resolution. The controller 10 communicates via a bus, such as a system bus 14 with an external device, such as a processor or memory (not shown). For example, a processor (not shown) will send color pixel data representing an image to be displayed to a memory, such as a display buffer. The controller 10 will then access the display buffer at a predetermined rate to display the desired image on the LCD 12. As used herein, the term external means external to the controller 10, but not necessarily a separate chip or device. For example, if the controller 10 is formed as one element of a System on a Chip (SoC), then the external memory or processor is located on the same chip but comprises a separate circuit element. The system bus 14 is used to pass signals such as data, addressing and control signals between various circuits or devices. The bus 14 may have a width in accordance with the requirements of the system, such as 16, 32, 64 or 128 bits.

The controller 10 includes a memory unit 16 that receives display data from the bus 14 and temporarily stores the display data. The memory unit 16 includes a DMA controller 18 and a FIFO memory 20. The DMA controller 18 is connected between the bus 14 and the FIFO memory 20. The DMA controller 18 is a type that is well known to those of skill in the art. The DMA controller 18 facilitates communications between the bus 14 and the FIFO memory 20. Simply, the DMA controller 18 makes requests to the system bus controller and fetches display data for the FIFO memory 20. When the FIFO memory 20 is close to empty or at a predefined usage value, the DMA controller 18 is triggered to fetch additional data. The DMA controller 18 receives the display data from the bus 14 and stores the received data in the FIFO memory 20. FIFO memories are also known by those of skill in the art and are commonly found in video controller circuits. The FIFO memory 20 receives data and the data is read out in the order in which it is stored. The FIFO memory 20 is used to store a stream of pixels a portion at a time. The FIFO memory 20 may be sized to hold 16 or 32 words (or double words) of data. However, the FIFO memory 20 could be smaller or larger. The FIFO memory 20 includes one or two pointers 21*a*, 21*b* (read and write) that define the locations of the data to be accessed. The pointers 21*a* and 21*b* are updated automatically. The values of the pointers 21*a*, 21*b* are monitored such that a bus overload condition can be detected. For example, an overload condition signal is generated when the read pointer value is equal to the write pointer value. The rate of change of the pointers 21*a*, 21*b* depends on a number of variables, such as the mode of operation of the display, the rate of filling of the FIFO memory 20 as determined by the interval of pixel and memory clocks, and the speed at which the (external) memory or processor can place display data on the bus 14. Suffice it to say that the DMA controller 18 and the FIFO memory 20 work together to keep a stream of pixels available to be displayed on the LCD 12.

A data converter 22 is connected to the memory unit 16 and receives the display data stored in the FIFO memory 20. The data converter 22 converts the display data to a converted data having a predetermined format. More particularly, the data converter 22 performs operations such as frame modulation and dithering for gray scaling in monochrome mode and mapping of colors by look up using a palette table. Such dithering operations are known by those of skill in the art and are not the focus of the present invention.

The converted data is provided to an interface logic unit 24 prior to providing the display data to the LCD 12. The interface logic unit 24 formats the converted data in accordance with a predetermined display format, such as for various types of LCD panels. More particularly, the interface logic unit 24 combines the display data signals with control signals, such as line pulse and frame pulse signals. Such interface logic is known by those of skill in the art and a detailed discussion is not required for a complete understanding of the invention.

A display data generator 26 is connected to the data converter 22 for receiving the converted data and generating temporary display data therefrom using a predefined algorithm. The temporary display data is then stored in a holding register 28. That is, in order to provide display data to the LCD 12, even under the condition where the FIFO memory unit 20 may need new data but the system bus 14 is unable to provide new data, for instance, due to a bus over load condition, the present invention includes a means for generating and holding a line of temporary display data that can be provided to the LCD 12 when the FIFO memory unit 20 is unable to provide display data. More particularly, the display data generator 26 generates a next line of display data that can be provided to the LCD 12 when the FIFO memory 20 is unable to provide the next line of data, in order to reduce image flicker.

Referring now to FIG. 2, is a schematic diagram for showing how temporary display data is generated by the display data generator 26 in accordance with one embodiment of the invention is shown. The display data generator 26 receives the converted display data, a line at a time, from the data converter 22 and generates a next line of data using a predefined algorithm. A line of the converted data received from the data converter 22 is shown at 30. The line of data 30 includes N bits of data broken up into subgroups $G_0$ to $G_k$, with each subgroup having eight (8) bits. In one embodiment of the invention, the algorithm takes an average of the eight bits in a subgroup to generate the pixel data shown at 32, in which there are eight (8) pixels per subgroup. For example, for subgroup $G_0$, an average of the eight bits $P_0$ to $P_7$ is determined to generate bits $P_{g0}$ to $P_{g7}$ where $P_{g0}=P_{g1}=P_{g2}=P_{g3}=P_{g4}=P_{g5}=P_{g6}=P_{g7}$. In another embodiment, the predefined algorithm calculates a majority for eight (8) bits to generate the pixel data, as opposed to calculating an average. In yet another embodiment, the predefined algorithm combines the two algorithms described above in such a way that an average is calculated for less than or equal to four (4) pixels having the same color and a majority is calculated for greater than four (4) pixels having the same color.

Referring again to FIG. 1, the generated data is stored in the internal holding register 28. The holding register 28 is sized to store at least one word of the generated display data and thus, has a size that is related to the size of the LCD 12. The holding register 28 is preferably one-eighth or one-sixteenth the number of pixels of one line of the panel. The holding register 28 provides the line of generated temporary data to the interface logic unit 24 by way of a multiplexer 34. The multiplexer 34 is connected to the data converter 22 and the holding register 28 and receives the converted data from the data converter 22 and the generated temporary display data from the holding register 28. The multiplexer 34 selects and outputs one of the converted data and the generated temporary display data in accordance with a bus overload signal 36 that indicates a predetermined condition of the bus 14. The bus overload signal 36 is active when the FIFO memory unit 20 does not have correct data, such as when there is a bus overload condition. In one embodiment, the bus overload signal 36 is derived using one or both of the memory pointers 21*a*, 21*b*, such as described above when the value of the memory pointer 21*a* is the same as the value of the memory pointer 21*b*.

In operation, the video controller 10 processes video display data received from the system bus 14 and provides LCD display data to the LCD 12. First, the controller receives display data transmitted over the bus 14 and stores the received display data in the memory unit 16. The display data stored in the memory unit 16 is read out in a FIFO manner and converted to a predetermined format with the data converter 22. The formatted display data is then provided to a first input of the multiplexer 34 and to the display data generator 26. The display data generator 26 generates temporary display data using the formatted display data in accordance with a predefined algorithm, as described above, and stores the generated temporary display data in a holding register 28. The holding register 28 has an output connected to a second input of the multiplexer 34. The multiplexer 34 selects one of the formatted display data and the generated temporary display data in accordance with the bus overload signal 36 and outputs the selected data to the LCD 12. Thus, there is always data available to be displayed, even if the FIFO memory unit 20 has erroneous data due to, for example, a bus overload condition.

The LCD controller of the present invention provides for flicker free image display by managing system bus overload, uncontrollable system bus usage such as external DMA transfers, and exceptional system bus utilization. The present invention allows for wide fluctuations of system bus loading, is independent of system bus architecture, CPU core and technology. Further, an LCD controller of the present invention works well in a large number of bus master systems. The LCD controller may be implemented as a separate controller chip or in any System on a Chip (SoC) design.

The detailed description provides preferred exemplary embodiments only and is not intended to limit the scope, applicability or configuration of the invention. Rather, the detailed description of the preferred exemplary embodiments provides those skilled in the art with an enabling description for implementing the preferred exemplary embodiment of the invention. It should be understood that various changes can be made in the function and arrangement of elements without departing from the scope of the invention as set forth in the appended claims.

The invention claimed is:

1. A video display controller, comprising:

a memory unit that receives display data from an external bus and temporarily stores the display data;

a data converter connected to the memory unit for receiving the display data therefrom and converting the display data to a converted data having a predetermined format;

a display data generator connected to the data converter for receiving the converted data and generating temporary display data therefrom using a predefined algorithm;

a holding register connected to the display data generator for storing the generated temporary display data; and a multiplexer connected to the data converter for receiving the converted data and the holding register for receiving the generated temporary display data, wherein the multiplexer selects and outputs one of the converted data and the generated temporary display data in accordance with a bus overload signal that indicates a predetermined condition of the external bus.

2. The video display controller of claim 1, further comprising an interface logic unit connected to the multiplexer for receiving the multiplexer output signal and reformatting the multiplexer output signal in accordance with a predetermined display format.

3. The video display controller of claim 2, wherein the video display controller is connected to a liquid crystal display and the interface logic unit formats the multiplexer output signal to a predetermined LCD format.

4. The video controller of claim 1, wherein the memory unit includes a DMA controller and a FIFO memory, wherein the DMA controller is connected between the external bus and the FIFO memory and the DMA controller receives the display data from the external bus and stores the received data in the FIFO memory.

5. The video controller of claim 4, wherein the bus overload signal is derived from the read and write pointers of the FIFO memory.

6. The video controller of claim 1, wherein the bus overload signal indicates a bus overload condition.

7. The video controller of claim 1, wherein the data converter performs modulation and dithering operations, and color mapping using a palette table on the stored display data.

8. The video controller of claim 1, wherein the predefined algorithm comprises breaking a current line of the converted display data into subgroups and calculating an average using the subgroup bits to generate bits of the temporary display data.

9. The video controller of claim 1, wherein the predefined algorithm comprises breaking a current line of the converted display data into subgroups and calculating a majority using the subgroup bits to generate bits of the temporary display data.

10. The video controller of claim 1, wherein the holding register is sized to store at least one word of the generated display data.

11. A LCD controller that receives display data from an external bus and provides modified display data to an LCD, the LCD controller comprising:

a DMA controller connected to the external bus for fetching and receiving display data transmitted over the external bus;

a FIFO memory connected to the DMA controller for receiving and temporarily storing the display data;

a data converter connected to the FIFO memory for receiving the display data therefrom and converting the display data to converted data having a predetermined format;

a display data generator connected to the data converter for receiving the converted data and generating temporary display data therefrom using a predefined algorithm;

a holding register connected to the display data generator for storing the generated temporary display data;

a multiplexer connected to the data converter for receiving the converted data and the holding register for receiving the generated temporary display data, wherein the multiplexer selects and outputs one of the converted data and the generated temporary display data in accordance with a bus overload signal that indicates a predetermined condition of the external bus; and an interface logic unit connected to the multiplexer for receiving the multiplexer output signal and reformatting the multiplexer output signal in accordance with a predetermined display format and providing the reformatted output signal to the LCD.

12. The video controller of claim 11, wherein the predefined algorithm comprises breaking a current line of the converted display data into subgroups and calculating an average using the subgroup bits to generate bits of the temporary display data.

13. The video controller of claim 11, wherein the predefined algorithm comprises breaking a current line of the converted display data into subgroups and calculating a majority using the subgroup bits to generate bits of the temporary display data.

14. A method of processing display data received from a bus and provided to a LCD, the method comprising the steps of:

receiving display data from an external bus and storing the received display data in a memory unit;

reading the display data stored in the memory unit;

converting the read display data to a predetermined format;

providing the formatted display data to a first input of a multiplexer and to a display data generator;

the display data generator generating temporary display data using the formatted display data in accordance with a predefined algorithm;

storing the generated temporary display data in a holding register;

providing the temporary display data from the holding register to a second input of the multiplexer;

selecting by the multiplexer one of the formatted display data and the generated temporary display data in accordance with a bus overload signal; and outputting the selected data to a display device.

15. The method of processing display data of claim 14, wherein the predefined algorithm comprises breaking a current line of the converted display data into subgroups and calculating an average using the subgroup bits to generate bits of the temporary display data.

16. The method of processing display data of claim 14, wherein the predefined algorithm comprises breaking a current line of the converted display data into subgroups and calculating a majority using the subgroup bits to generate bits of the temporary display data.

* * * * *